United States Patent [19]

Müller et al.

[11] 4,265,677

[45] May 5, 1981

[54] PHOSPHATIZING PRIOR TO CATHODIC ELECTROPAINTING

[75] Inventors: Gerhard Müller, Hanau; Werner Rausch, Oberursel, both of Fed. Rep. of Germany

[73] Assignee: Oxy Metal Industries Corporation, Warren, Mich.

[21] Appl. No.: 124,504

[22] Filed: Feb. 25, 1980

[30] Foreign Application Priority Data

Feb. 23, 1979 [DE] Fed. Rep. of Germany ..... 2907094

[51] Int. Cl.[3] ..... C23F 7/08

[52] U.S. Cl. ..... 148/6.15 Z; 204/181 C

[58] Field of Search ..... 148/6.15 Z; 204/181 C

[56] References Cited

U.S. PATENT DOCUMENTS

| | | | |
|---|---|---|---|
| 3,597,283 | 8/1971 | Snee | 148/6.15 Z |
| 3,617,393 | 11/1971 | Makazawa | 148/6.15 Z |
| 3,617,458 | 11/1971 | Brockman | 204/181 C |

FOREIGN PATENT DOCUMENTS

| | | | |
|---|---|---|---|
| 2232067 | 1/1973 | Fed. Rep. of Germany | 148/6.15 Z |

*Primary Examiner*—Ralph S. Kendall

*Attorney, Agent, or Firm*—Arthur E. Kluegel; Richard P. Mueller

[57] ABSTRACT

A new composition and process provide improved phosphate treatment prior to cathodic electropainting. The surface is contacted with an aqueous acidic zinc phosphate solution having a weight ratio of $Zn:PO_4$ of 1:12–110 and 0.3 to 2.0 g/l fluoborate prior to electropainting.

5 Claims, No Drawings

PHOSPHATIZING PRIOR TO CATHODIC ELECTROPAINTING

BACKGROUND OF THE INVENTION

It has been known for some time to prepare metal surfaces for subsequent painting by applying a phosphate coating so as to attain improved corrosion protection and better paint adhesion. The primarily used base coats for electric immersion coating are zinc phosphate coatings. To produce these, aqueous acid coating solutions are usually used on a base of mono-zinc-phosphate to which chlorate, nitrite, nitrate, organic nitro-compounds or mixtures thereof are added as catalyzers. The resulting coatings are, however, not satisfactory for subsequent painting because of their thickness and coarse crystallinity. As thin and fine grained coatings are desired for pre-treatment prior to electric immersion painting, various organic or inorganic chelating agents, such as citric acid, tartaric acid, malonic acid, polyphosphoric acid, glycerol phosphoric acid, ethylene-diamintatra acetic acid, nitrilotri-acetic acid, or their salts, are often added to the solutions. This, however, results often in problems with controlling the solutions; also, the coatings frequently do not meet the required standards. See U.S. Pat. Nos. 3,523,043; 3,597,283; 3,617,393; 3,647,568.

A disadvantage of the coatings with the known solutions on the base of mono-zinc-phosphate for subsequent electric immersion coating consists particularly in the fact that a considerable part of the phosphate coating is separated during the painting process and is absorbed by the paint-film with detrimental results.

German Published Application No. P 22 32 067 avoids these disadvantages, in that it provides treatment solutions in which the zinc portion in relation to the phosphations is considerably lower than in the customary solutions on a base of mono-zinc-phosphate. The treatment results in improved thin and even phosphate coatings on metal surfaces, particularly iron and steel, with good adhesive strength and durability, and are particularly well suited for subsequent electric immersion coating. The phosphate coatings provide excellent corrosion protection and are separated during painting to a much lesser degree than the coatings from the heretofore known solutions. The described solutions are easily controlled, as chelating agents need not be added in order to attain the desired thin and evenly fine coatings. The ratio of $Zn:PO_4$ is easily controlled. The solutions contain the usual amounts of $PO_4$, e.g. ab. 5–20 g/l, but considerably less zinc.

SUMMARY OF THE INVENTION

It has been found that the considerable advantages obtained by the solution and process of the German Patent Application wherein the weight ratio of $Zn:PO_4$ is 1:12–110, can be further improved if the treatment solutions corresponding to the invention also contain fluoborate, preferably in amounts of 0.3 to 2.0 g/l.

DETAILED DESCRIPTION OF THE INVENTION

The phosphate coatings obtained with the treatment solutions according to the invention result in such high degree of corrosion protection (increased underrun protection), that subsequent treatment with the known rinse agents, e.g. Cr(VI)— or Cr(III)— ion-containing, results in practically no additional improvement. This means that the phosphate coatings produced with this invention are of a quality which is otherwise obtained only with additional rinse agents.

As in the German Application, catalyzers are preferably also added to the treatment solutions according to the invention. Chlorates are particularly well suited. For phosphatizing iron and steel it is sufficient to add just enough chlorate as needed to remove excess ferro-ions by oxidation. Therefore the amounts of catalyzer depend on the permeation and do not have to be specially adjusted to the amount of zinc-ions and phosphoric acid, as prescribed with the known methods. However, it has been shown that the chlorate contents should be at least 0.1 g/l. Larger amounts are recommended for high throughputs. The additional use of nitrite is good for attaining the desired results. Also nitrate together with chlorate is effective.

Vanadium compounds can also be added to the solutions, for instance in amounts of 0.1 to 10 mg/l vanadium, which has proven to be particularly effective with high throughputs. Additional multivalent cations, such as nickel, manganese or calcium, in amounts of not more than 0.5 g/l, effect an additional improvement.

An additive of alkali-metal ions (Na, $NH_4$, etc.) is required so as to bind that portion of $PO_4$ that exceeds the required degree of free acid.

EXAMPLE A

Degreased sheets of steel were treated for 2 minutes by spraying with a phosphatizing solution at 58° C., which contained:

0.69 g/l:Zn
0.38 g/l:Ni
0.018 g/l:Fe(III)
11.4 g/l:$PO_4$
1.6 g/l:$NO_3$
0.07 g/l:$NO_2$
1.49 g/l:$ClO_3$
2.8 g/l:Na.

The value for free acid was at 0.8, for total acid 14.5. The sheets were then rinsed with water and fully deionized water and were subsequently dried.

The coating weight obtained was 1.8 g/m$^2$.

Thereafter a modified epoxy-resin paint was cathodically deposited on the pre-treated sheet. The electro-immersion bath was at room temperature, separation voltage and time were 180 volts for 2 minutes. Thereafter the paint was baked for 25 minutes at a temperature of 190° C. The paint coating obtained thereby was 15 μm, uniform and glossy.

The corrosion protection of the painted and scribed sheets was tested in the ASTM salt-spray test (1000 hrs.). The under-migration found after the test was 1 to 2 mm.

EXAMPLE B

The above described process was repeated in every detail. However, a phosphatizing solution was used, which in addition to the components shown in EXAMPLE A also contained:

0.8 g/l:$BF_4^-$

The salt-spray test established under-migration of less than 1 mm.

EXAMPLE C

The treatment process according to EXAMPLE B was varied in that instead of a water rinse, the sheets were rinsed once with chromium (III)-acetate solution (150 mg/l Cr(III) and once with chromic acid/-chromium (III)-acetate solution (150 mg/l Cr(VI), 40 mg/l Cr(III)).

The salt-spray test after painting gave the same results as under EXAMPLE B.

Comparison of the results shows that the corrosion protection, particularly protection against under-migration of the phosphatizing solution modified with fluorborate is considerably better than that which is obtained in phosphatizing solutions without fluoborate. It can also be seen that even without rinsing with Cr(III)-rest. Cr(VI)-solution, corrosion protection that practically equals that with the mentioned solutions is obtained.

What is claimed is:

1. An aqueous acidic solution suitable for treating a metallic surface prior to cathodic electropainting comprising zinc and phosphate ions in a weight ratio of 1:12–110, an additional multivalent cation in an amount not more than 0.5 g/l, and from 0.3 to 2.0 g/l of fluoborate ions.

2. The solution of claim 1, additionally containing chlorate ions.

3. The solution of claims 1 or 2, additionally containing nitrite ions.

4. The solution of claims 1 or 2, additionally containing from 0.1 to 10 mg/l of vanadium as a vanadium compound.

5. In a process for painting a metal surface by cathodic electrodeposition, the improvement comprising contacting the metal surface with the solution of claim 1 prior to contacting the surface with the paint.

* * * * *